United States Patent [19]

Powell et al.

[11] 4,139,166

[45] Feb. 13, 1979

[54] SURFACE WIND BATCHER

[75] Inventors: Jack D. Powell, Greer; Jochem Schoellkopf, Spartanburg, both of S.C.

[73] Assignee: Menzel, Inc., Spartanburg, S.C.

[21] Appl. No.: 804,785

[22] Filed: Jun. 8, 1977

[51] Int. Cl.[2] ..... B65H 17/08

[52] U.S. Cl. ..... 242/66

[58] Field of Search ..... 242/66, 65, 67.1 R

[56] References Cited

U.S. PATENT DOCUMENTS

| | | | |
|---|---|---|---|
| 798,241 | 8/1905 | Warren | 242/66 |
| 2,012,118 | 8/1935 | Cameron | 242/66 |
| 2,547,399 | 4/1951 | Leveridge | 242/66 X |
| 2,901,191 | 8/1959 | Phelps | 242/66 |

*Primary Examiner*—Edward J. McCarthy

*Attorney, Agent, or Firm*—Wellington M. Manning, Jr.; Luke J. Wilburn, Jr.

[57] ABSTRACT

A surface wind batcher for producing a tightly wound compact roll of web goods on an A frame or the like having a support frame with a wind arm structure pivotally secured at an upper end thereof. A pair of driven rolls are pivotally mounted at an outer free end of the wind arm structure with the first of said rolls being rotated at one speed and the second of said rolls being rotated at a greater speed than the first to ensure compactness of the roll of web goods as it is produced. The rolls may be driven by a suitable source of power such as an electric motor or a hydraulic motor. A hydraulic or air cylinder arrangement is secured between the support frame and the underside of the wind arm structure to permit lifting of the wind arm structure and driven rolls off the web as desired, and optionally, to hold the driven rolls in contact with the web as the roll is being produced. The faster driven roll preferably operates at a speed of three to five percent faster than the first driven roll.

11 Claims, 3 Drawing Figures

SURFACE WIND BATCHER

BACKGROUND OF THE INVENTION

The present invention relates to apparatus for producing a tightly wound roll of web goods such as a textile fabric or the like.

Apparatus for producing large rolls of web goods of indeterminate length have been produced heretofore and have experienced problems in the compaction of the roll during production such that the surface of particular fabrics, e.g., corduroys, etc. have been distorted within the roll and such that the ends of the rolls are uneven. Such a roll of web goods is difficult to unwind and presents subsequent processing and handling problems.

The present invention enables the production of a very compact roll of web goods of indeterminate length without damaging the web or permitting the web to shift during production of the roll. As such, an improved roll of web goods is produced.

SUMMARY OF THE INVENTION

It is an object of the present invention to provide an improved surface wind batcher for producing a roll of web goods of indeterminate length.

Another object of the present invention is to provide apparatus for the production of an improved, compact roll of web goods of indeterminate length.

Yet another object of the present invention is to provide an improved apparatus for receiving a web of indeterminate length and producing a compact, uniform roll of same.

Generally speaking, the apparatus of the present invention comprises a support frame, a wind arm structure pivotally secured to said frame and extending outwardly therefrom, a pair of driven rolls provided adjacent a free end of said arm structure, one of said rolls being driven at a faster rotational rate than an other of said rolls, and drive means for said rolls.

More specifically, the surface wind batcher of the present invention includes a free standing support frame to which the wind arm structure is pivotally secured for variable placement depending upon the size of the roll of web goods as it is being produced. Initially, the wind arm structure presents the rotatable driven rolls at the beginning of the web roll, and as the web roll grows the wind arm structure moves outwardly, riding on the surface of the web. Web that is used to produce the web roll is fed through the arm structure where it may encounter one or more idler tension rolls or bars prior to being wrapped around the first driven draw roll. The web preferably moves in a counterclockwise direction around the outer periphery of the then existing web roll. Just prior to making one complete revolution around the roll being produced, the web encounters the second driven, packer roll which is rotating at a faster rate of speed than the draw roll whereby the web is drawn tightly around the existing roll structure prior to making the complete revolution. In a preferred embodiment, the packer roll, is rotating at a rate of three to five percent faster than the draw roll. The arm structure is supported on its underside by a cylinder arrangement which is used to lift the arm structure from the roll as desired. Air, hydraulics or the like may be employed for operation of the cylinder, and the cylinder may be of a double acting type to hold the draw and packer rolls on the web and lift the draw and packer rolls off the web when desirable.

In one embodiment, the surface wind batcher may be electrically operated. Timing belts or the like may be provided along one or both sides of the wind arm structure, being connected to a jack shaft. The draw and packer rolls may then be driven from the jack shaft by a chain drive or the like. The faster driven, packer roll is associated with the jack shaft through a gearing arrangement that provides the increased rotational speed. In a hydraulic embodiment, hydraulic fluid is stored in a reservoir, preferably in the base of the support frame, with hydraulic lines running along an edge of the pivoted wind arm structure to a hydraulic motor located on one side of the outer free end of the wind arm structure and in driving connection with the jack shaft.

As opposed to other batchers having a surface drive capability, the wind arm structure that is pivoted to the main support frame of the present invention is not counterweighted for balance, but instead, applies continuous pressure on the web roll as it is being produced to improve compactness of the roll.

A double acting cylinder arrangement as mentioned above, assists in maintenance of the continuous pressure.

DESCRIPTION OF THE PREFERRED EMBODIMENTS

Figure 1:
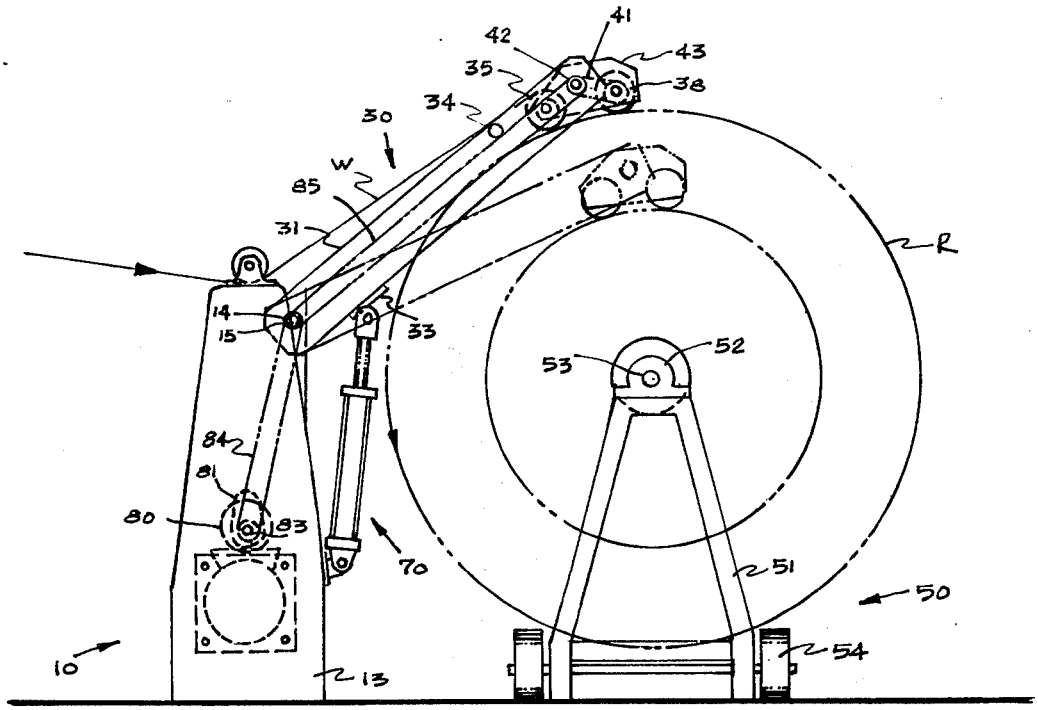
FIG. 1 is a side elevational view of a surface wind batcher according to the teachings of the present invention.
Figure 2:
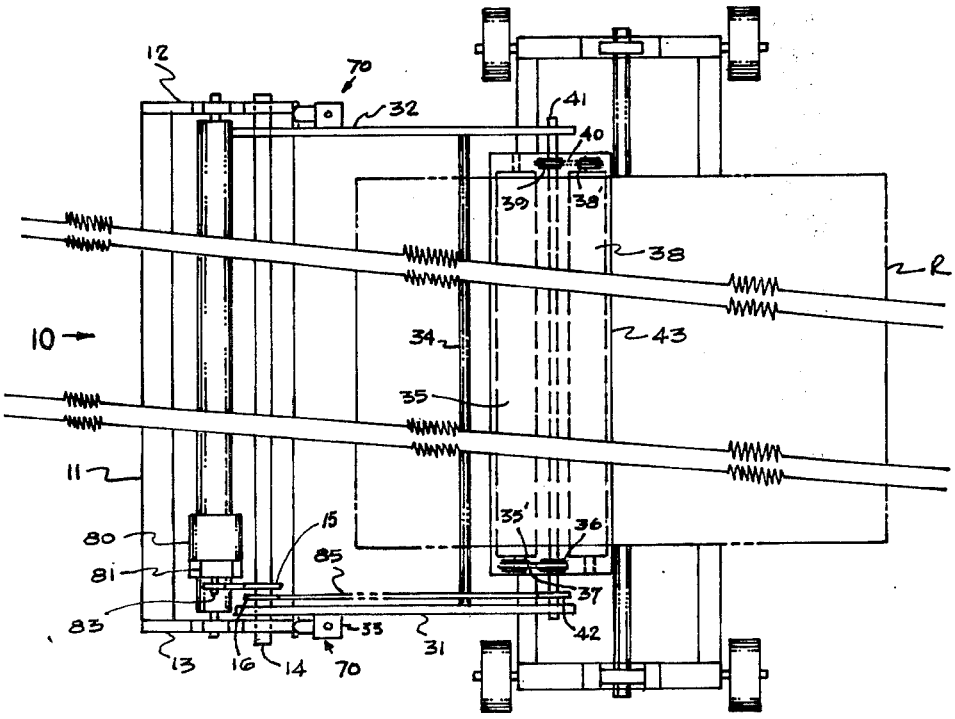
FIG. 2 is a top view of the embodiment of the present invention as shown in FIG. 1.

Making reference to the drawings, preferred embodiments of the present invention will now be described in detail. In FIGS. 1 and 2, one embodiment of the present invention is shown wherein a support frame generally indicated as 10 is provided having a wind arm structure generally indicated as 30 pivotally secured to an upper end thereof and extending outwardly over a location where a roll of web goods will be produced on a rotatable support generally indicated as 50 such as an A-frame or the like. Support frame 10 is comprised of a base 11 having vertical supports 12 and 13 secured thereto and extending upwardly therefrom. A shaft 14 is secured to vertical members 12 and 13 and extends across the space between same. Wind arm structure 30 is secured to shaft 14 for pivotal movement thereabout and extends outwardly therefrom. Wind arm structure 30 is supported on the underside of same by a cylinder-piston arrangement generally indicated as 70 which is used to raise arm structure 30 from the roll R of web goods produced, and optionally may be used as will be described hereinafter to hold the driven rolls against the web roll during production of the web roll R.

Arm structure 30 comprises a pair of elongated end members 31 and 32 that extend outwardly in parallel relationship, with a perpendicular support member 33 secured therebetween, adjacent the pivotal connection of arm 30 to shaft 14 of support 10. Cylinder-piston unit 70 is secured to perpendicular support member 33. Wind arm structure 30 further has, as optional elements, one or more tensioning means, preferably in the form of cylindrical bars or rollers 34 that extend across the space between end members 31 and 32, across the path of a web material W. Web material W may thus encounter the tensioning means 34 to maintain an appropriate web tension prior to its being wound into web roll R. A pair of driven rolls 35 and 38 respectively are located at the outer free end of wind arm structure 30. A jack shaft 41 is secured between end member 31 and 32 of arm structure 30 and pivotally supports a bonnet 43 to which rolls 35 and 38 are rotatably mounted. Bonnet 43 is pivotally connected to arm structure 30 about jack shaft 41 and thus provides a pivotal mounting for rolls 35 and 38 so that they make proper contact with the surface of web roll R during roll production regardless of the diameter of same.

A source of driving power 80 is provided on support frame 10, exemplified in FIG. 1 as an electric motor system. An in line reducer 81 is associated with motor 80 with motor shaft 83 extending outwardly therefrom. Motor shaft 83 has a drive pulley located thereon which is in driving association with a pulley 15, located on arm pivot shaft 14, through a timing belt, chain or the like 84. A second pulley or sprocket 16 is located on arm pivot shaft 14 and is in driving association with a sprocket or pulley 42 on jack shaft 41 through a timing belt, chain or the like 85.

Jack shaft 41 has a pair of further sprockets, 36 and 39 which are drivingly associated with draw roll 35 and packer roll 38 through draw roll sprocket 35' and packer roll sprocket 38' and chain drives 37 and 40 respectively. Hence, driving power for draw roll 35 and packer roll 38 is taken from jack shaft 41 and speed rates are determined by the number of teeth in the respective sprockets.

The roll of web goods is produced on a suitable support 50 as exemplified by an A-frame. A-frame 50 is defined by structural elements 51 which wheels 54 are rotatably mounted for mobile support of same. A suitable journal 52 is provided atop supports 51 at each end of A-frame 50 and receives a shaft 53 journaled therein around which the web roll R is produced. As illustrated in FIGS. 1 and 2, a web path extends from a web supply (not shown) across the pivotal end of wind arm structure 30 across tensioning bars 34, and across the top of draw roll 35, passing therearound and proceeding in counterclockwise direction under shaft 52 and across the top of the then size of roll R, beneath packer roll 38. Packer roll 38 rotates at a faster rotational speed than the draw roll 35 whereby a greater tension is imparted to web W and a compact roll R of web goods is formed. Preferably, packer roll 38 operates at a rotational speed of from three to five percent faster than draw roll 35. As shown in phantom in FIG. 1, wind arm structure 30 resides on the existing surface of the roll R of web goods W with draw roll 35 and packer roll 38 being in contact therewith. In this regard, a cylinder arrangement 70 is shown secured between base support 10 and arm structure 30. Cylinder 70 may be an air cylinder, hydraulic cylinder or the like, and preferably is double acting such that rolls 35 and 38 are held on the surface of roll R of web goods W during production of the roll and may be raised off of roll R after the same has been produced.

Figure 3:
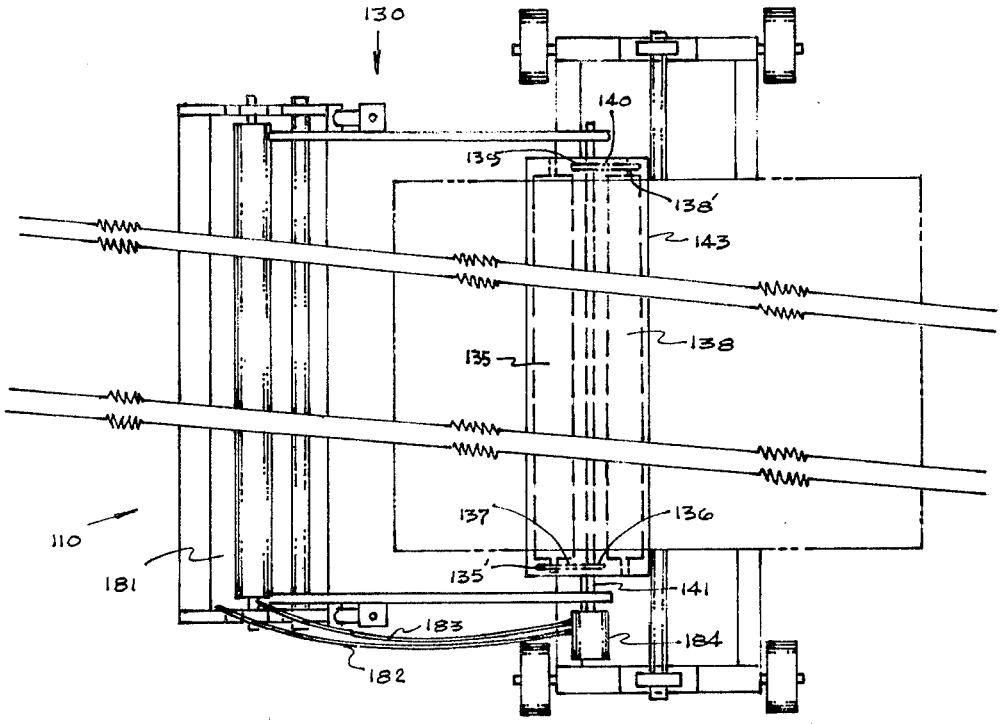
FIG. 3 is a top elevational view of a further embodiment of the present invention.

A further embodiment of the present invention is illustrated in FIG. 3 where a base frame generally indicated as 110 is provided having a wind arm structure generally indicated as 130 pivotally secured thereto with a draw roll 135 and a packer roll 138 rotatably secured to a bonnet 143 or the like at the outer free end of arm structure 130. A hydraulic power source is illustrated and support 110 has a hydraulic reservoir 181 thereon with hydraulic lines 182 and 183 in communication with reservoir 181 at one end and extending outwardly along wind arm structure 130 to a hydraulic motor 184 located adjacent an outer end of jack shaft 141 that is secured to outer free end of arm structure 130. Shaft 141 has a pair of drive sockets 136 and 139 secured thereto, and in driving association with complimentary sprockets 135' and 138' respectively that are located on the rotatable shafts for draw roll 135 and packer roll 138 through respective chains 137 and 140. Gearing arrangement for packer roll 138 is adjusted to produce a rotational speed in excess of that of draw roll 135, preferably in the amount of approximately three to five percent. Other than the particular motive power source as indicated in FIG. 3, the remainder of the structure of the surface driven batcher could be the same as that of FIGS. 1 and 2.

In a most preferred arrangement for the electric system illustrated in FIGS. 1 and 2, the driving connections 84 and 85 are timing belts while in the embodiments shown in FIGS. 1, 2, and 3, the driving connections 37 and 40 and 137 and 140 between the jack shaft 41 and 141 and the rolls are chains.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An improved surface wind batcher comprising:

(a) a support frame;

(b) an arm structure pivotally secured to said support frame and extending outwardly therefrom;

(c) a pair of driven rolls received at an outer free end of said arm structure, one of said rolls being driven at a faster rotational rate than the other of said rolls, said rolls being contactable with a web roll throughout the production of same; and (d) drive means for rotating said rolls, said drive means being connected to both driven rolls said one of said rolls being geared to a drive shaft for said faster rate of speed.

2. An improved surface wind batcher as defined in claim 1 wherein said arm structure extends outwardly from said pivotal securement in one major direction only.

3. An improved surface wind batcher as defined in claim 1 wherein said arm structure is supported by a cylinder-piston arrangement secured between said frame and the underside of said arm structure.

4. An improved surface wind batcher as defined in claim 1 wherein said one of said driven rolls rotates at a rate from about 3 to 5 percent faster than said other of said rolls.

5. An improved surface wind batcher as defined in claim 1 wherein said drive means comprises an electric motor operatively associated with said drive rolls.

6. An improved surface wind batcher as defined in claim 1 wherein the drive means is a hydraulic system with a hydraulic motor associated with an end of a drive shaft common to said rolls.

7. An improved surface wind batcher as defined in claim 6 wherein the pivotally mounted arm structure has a hydraulic cylinder-piston means connected thereto whereby said piston means can move said arm structure out of contact with said web, an opposite end of said piston means being connected to said support means.

8. An improved surface wind batcher comprising:

(a) a support frame;

(b) a wind arm structure pivotally secured to said support frame and extending outwardly therefrom, said structure having a driven rotatable shaft extending thereacross adjacent a free outer end of same;

(c) a bonnet pivotally secured to said rotatable shaft;

(d) a pair of driven rolls rotatably secured to said bonnet and in a driven relationship with said rotatable shaft, one of said rolls being driven at a faster rate than an other of said rolls;

(e) drive means for said rotatable shaft; and (f) a cylinder-piston arrangement secured between said support frame and an underside of said wind arm structure.

9. An improved surface wind batcher as defined in claim 8 wherein said drive means comprises an electric motor drivingly associated with said rotatable shaft.

10. An improved surface wind batcher as defined in claim 8 wherein the faster of said rolls operates at a speed of about 3 to about 5 percent faster than said other roll.

11. An improved surface wind batcher as defined in claim 8 wherein a hydraulic motor is drivingly associated with said rotatable shaft.

* * * * *